US011819128B2

(12) United States Patent
Janser

(10) Patent No.: US 11,819,128 B2
(45) Date of Patent: Nov. 21, 2023

(54) DRIVE DEVICE FOR A MOVEABLE FURNITURE PART

(71) Applicant: Julius Blum GmbH, Hoechst (AT)

(72) Inventor: Pascal Janser, Hoechst (AT)

(73) Assignee: Julius Blum GmbH, Hoechst (AT)

( * ) Notice: Subject to any disclaimer, the term of this patent is extended or adjusted under 35 U.S.C. 154(b) by 181 days.

(21) Appl. No.: 17/478,434

(22) Filed: Sep. 17, 2021

(65) Prior Publication Data

US 2022/0015537 A1 Jan. 20, 2022

Related U.S. Application Data

(63) Continuation of application No. PCT/AT2020/060028, filed on Jan. 31, 2020.

(30) Foreign Application Priority Data

Mar. 20, 2019 (AT) ..... A 50238/2019

(51) Int. Cl.
*A47B 88/463* (2017.01)
*A47B 88/473* (2017.01)
*A47B 88/45* (2017.01)

(52) U.S. Cl.
CPC ..... *A47B 88/463* (2017.01); *A47B 88/45* (2017.01); *A47B 88/473* (2017.01)

(58) Field of Classification Search
CPC ..... A47B 88/463; A47B 88/45; A47B 88/473; A47B 2210/0083
See application file for complete search history.

(56) References Cited

U.S. PATENT DOCUMENTS 9,215,929 B2 * 12/2015 Brunnmayr ..... A47B 88/47
9,622,578 B2 4/2017 Goetz et al.
(Continued)

FOREIGN PATENT DOCUMENTS

CN 105101840 11/2015
CN 105228490 1/2016
(Continued)

OTHER PUBLICATIONS

International Search Report dated Apr. 7, 2020 in International (PCT) Application No. PCT/AT2020/060028.

*Primary Examiner* — Hanh V Tran
(74) *Attorney, Agent, or Firm* — Wenderoth, Lind & Ponack, L.L.P.

(57) ABSTRACT

A drive device includes a carrier, an ejection device for ejecting a moveable furniture part out of a closed position, and a locking device for locking the ejection device in the locked position. The locking device has a locking pin connected to the ejection device and a guide track for the locking pin in or on the carrier. The locking pin is locked in an engaging recess of the guide track in the locked position, and a synchronization device is movable relative to the carrier for synchronizing the movement of the drive device with a second drive device. The synchronization device has a transmission element to be moved by the locking pin. The transmission element remains still with the overpressure movement, can be moved by the locking pin during opening movement, can be moved by the locking pin during closing movement, and is linearly moveably mounted on the carrier.

16 Claims, 15 Drawing Sheets

(56) References Cited

U.S. PATENT DOCUMENTS

Figure 1:
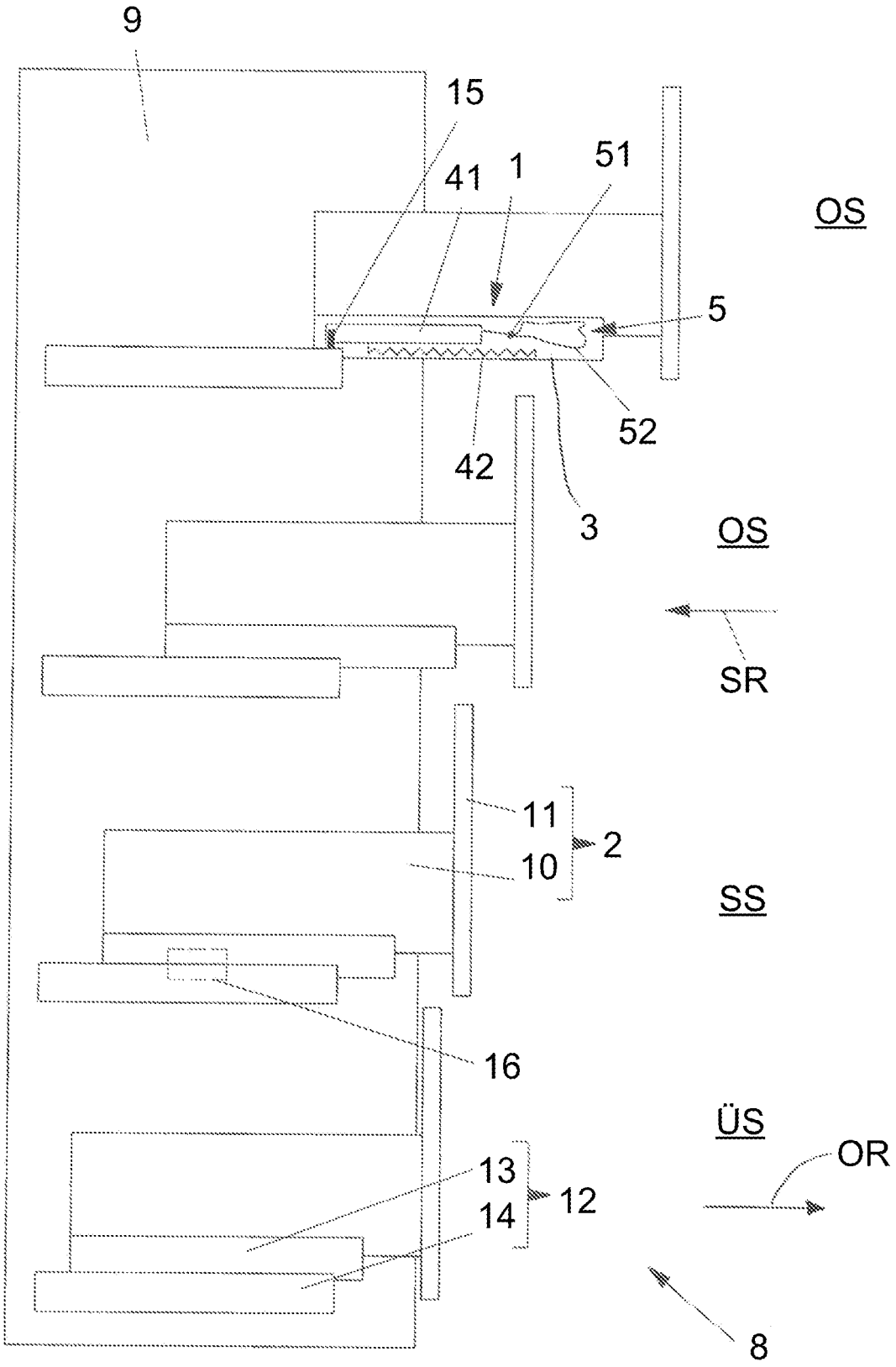

| | | | | |
|---|---|---|---|---|
| 9,642,461 | B2 | 5/2017 | Goetz et al. | |
| 9,717,334 | B2 | 8/2017 | Goetz et al. | |
| 10,070,721 | B2 | 9/2018 | Brunnmayr et al. | |
| 10,143,303 | B2 | 12/2018 | Koenig et al. | |
| 10,575,637 | B2 | 3/2020 | Wohlgenannt | |
| 10,750,861 | B2 * | 8/2020 | Wohlgenannt | E05C 19/063 |
| 11,006,747 | B2 | 5/2021 | Wohlgenannt | |
| 11,253,067 | B2 * | 2/2022 | Wohlgenannt | A47B 88/477 |
| 11,459,811 | B2 * | 10/2022 | Bantle | A47B 88/47 |
| 2012/0001441 | A1 * | 1/2012 | Juan | A47B 88/463 292/164 |
| 2012/0038255 | A1 * | 2/2012 | Netzer | A47B 88/463 312/319.1 |
| 2014/0021841 | A1 * | 1/2014 | Brunnmayr | A47B 88/57 312/319.1 |
| 2014/0327351 | A1 * | 11/2014 | Chung | A47B 88/463 312/333 |
| 2015/0091424 | A1 * | 4/2015 | Nuckolls | A47B 88/463 312/319.1 |
| 2015/0108891 | A1 * | 4/2015 | Brunnmayr | A47B 88/57 312/319.8 |
| 2015/0374123 | A1 * | 12/2015 | Goetz | E05B 65/462 312/319.1 |
| 2015/0374125 | A1 * | 12/2015 | Goetz | A47B 88/49 312/319.1 |
| 2016/0007748 | A1 * | 1/2016 | Gasser | A47B 88/47 312/319.1 |
| 2016/0007750 | A1 | 1/2016 | Goetz et al. | |
| 2016/0206093 | A1 * | 7/2016 | Brunnmayr | A47B 88/47 |
| 2016/0227927 | A1 * | 8/2016 | Goetz | A47B 88/407 |
| 2017/0020285 | A1 | 1/2017 | Schallert et al. | |
| 2017/0051813 | A1 * | 2/2017 | Karu | A47B 88/463 |
| 2017/0095084 | A1 | 4/2017 | Koenig et al. | |
| 2017/0135478 | A1 * | 5/2017 | Chen | A47B 88/467 |
| 2017/0265644 | A1 * | 9/2017 | Fischer | F16C 29/005 |
| 2017/0273456 | A1 * | 9/2017 | Davis | A47B 88/473 |
| 2018/0020833 | A1 * | 1/2018 | Goetz | A47B 88/463 312/331 |
| 2018/0125235 | A1 | 5/2018 | wohlgenannt | |
| 2018/0160807 | A1 * | 6/2018 | Wohlgenannt | E05C 19/022 |
| 2018/0160808 | A1 * | 6/2018 | Wohlgenannt | E05F 1/16 |
| 2018/0332963 | A1 * | 11/2018 | Chen | A47B 88/463 |
| 2019/0021494 | A1 * | 1/2019 | Bantle | A47B 88/47 |
| 2020/0205566 | A1 * | 7/2020 | Wohlgenannt | A47B 88/463 |
| 2022/0000264 | A1 * | 1/2022 | Janser | A47B 88/463 |

FOREIGN PATENT DOCUMENTS

| | | | | |
|---|---|---|---|---|
| CN | 106455811 | | 2/2017 | |
| CN | 106659298 | | 5/2017 | |
| CN | 107847048 | | 3/2018 | |
| CN | 107849885 | | 3/2018 | |
| DE | 20 2009 013 733 | | 5/2011 | |
| EP | 3 054 811 | | 12/2018 | |
| JP | 2016-532464 | | 10/2016 | |
| JP | 2016533805 | A * | 11/2016 | |
| JP | 2018-524104 | | 8/2018 | |
| WO | 2014/165873 | | 10/2014 | |
| WO | 2015/051386 | | 4/2015 | |
| WO | 2015/192153 | | 12/2015 | |
| WO | 2017/004638 | | 1/2017 | |
| WO | 2017/004639 | | 1/2017 | |
| WO | WO-2017059974 | A2 * | 4/2017 | A47B 88/463 |

* cited by examiner

OS

OS+VS

ÜS

OS

DRIVE DEVICE FOR A MOVEABLE FURNITURE PART

BACKGROUND OF THE INVENTION

The present invention concerns a drive device for a moveable furniture part, in particular for a drawer, comprising a carrier, an ejection device for ejecting the moveable furniture part out of a closed position into an open position. The ejection device is unlockable out of a locking position by an overpressing movement of the moveable furniture part into an overpressing position behind the closed position. A locking device is provided for locking the ejection device in the locking position, and the locking device has a locking pin connected to the ejection device. A guide track is provided at least partially in or on the carrier for the locking pin, and the locking pin in the locking position is locked in a latching recess in the guide track. A synchronization device is moveable relative to the carrier for synchronizing the movement of the drive device with a second drive device, and the synchronization device has a transmission element moveable by the locking pin. The transmission element is stationary at least in the overpressing movement, and is moveable in an opening movement by the locking pin, and is moveable in a closing movement by the locking pin. In addition, the invention concerns an arrangement comprising two synchronized drive devices. Furthermore, the invention concerns an article of furniture having such a drive device.

For many years now furniture fitments have been produced and used, which assist with the movements of moveable furniture parts (like for example drawers, doors and flaps of articles of furniture). So-called touch-latch mechanisms are known, with which an opening movement is triggered by pressing against the moveable furniture part. The action of pressing ("touch") against the moveable furniture part while in the closed position releases locking ("latch") of the locking device whereby the ejection device opens the moveable furniture part.

An example of a furniture fitment of that kind or for such a drive device is to be found in WO 2017/004638 A1. The locking pin after the overpressing action at the beginning of the opening movement moves a locking element which is provided on the partially sleeve-shaped synchronization coupling portion. That synchronization coupling portion corresponds to the transmission element of the present invention. WO 2017/004638 A1 however does not constitute a general state of the art in this respect as the synchronization coupling portion is moved only upon an opening movement by the locking pin. In the event of a closing movement of the moveable furniture part there is no transmission of movement from the locking pin to the synchronization coupling portion. Rather, in accordance with that specification, as the locking pin is no longer in contact with the synchronization coupling portion, the latter is moved by the synchronization force storage means again into that position in which the locking element arranged on the synchronization coupling portion again also forms the latching recess of the guide track. A disadvantage with that specification is that there must be an additional force storage means and that force storage means involves uncontrolled synchronization of a second drive device.

In contrast, EP 3 054 811 B1 discloses a drive device of the general kind set forth. Therein, the coupling element corresponds to the transmission element of the present invention. The locking element which also forms the latching recess is provided on that coupling element. That coupling element is not acted upon by a force storage means.

Rather, in a closing movement, by virtue of the locking pin, the coupling element is moved into that position in which the locking element on the coupling element again also forms the latching recess of the guide track. A disadvantage with that specification is that the rotatable coupling element is relatively large and takes up a great deal of space. In addition synchronization is quite complicated with the many levers and components which are necessary by virtue of the rotary movement of the coupling element.

SUMMARY OF THE INVENTION

The object of the present invention is therefore to provide a drive device which is improved over or is an alternative to the state of the art. In particular the invention seeks to overcome the known disadvantages of the state of the art. Above all the invention seeks to provide that the drive device is of a simple structure, requires relatively little space, and includes few components.

Accordingly, in accordance with the invention, the transmission element is linearly moveably mounted to the carrier. Thus there is no need for a complicated rotary movement, that requires a relatively large amount of space, on the part of the transmission element.

Preferably, the guide track has a cardioid-shaped portion.

Further preferably, arranged on the transmission element is a locking element for the locking pin, that also forms the guide track.

Preferably, the locking pin is locked in the locking position in the latching recess of the guide track, the latching recess is at least partially formed by the locking element moveable relative to the carrier, and the locking pin is held in the locking position on the locking element, preferably at a holding surface provided on the locking element. More particularly, the locking element, starting from a latching recess-forming position, in a given locking position, can be linearly moveable in opposite relationship to the direction in which the locking pin moves in the overpressing movement.

Preferably, the ejection device has an ejection slide moveable relative to the carrier and an ejection force storage means fixed on the one hand to the carrier and on the other hand to the ejection slide. Preferably, the ejection force storage means is in the form of a spring, preferably a tension spring.

In a preferred embodiment, the transmission element has a first transmission abutment projecting into an opening portion of the guide track, wherein in the opening movement the transmission element is moveable by the locking pin by way of said first transmission abutment. In that way, that movement can be transmitted to a second drive device.

Particularly preferably, the first transmission abutment is formed by an end face which is provided on the locking element and which is preferably oriented transversely relative to the holding surface. Accordingly, the locking element has a dual function by a part (specifically the holding surface) serving to lock or latch the locking pin and a part (specifically the end face) being provided for the transmission of movement to a second drive device.

It is also preferable that the transmission element has a second transmission abutment projecting into a closing portion of the guide track, wherein in the closing movement the transmission element is moveable by the locking pin by way of the second transmission abutment.

More especially, the locking element is moveable into a latching recess-forming position in which the locking element also forms the latching recess of the guide track, preferably exclusively, by the movement of the transmission element which is triggered in the closing movement by the locking pin by way of the second transmission abutment.

Further preferably, the second transmission abutment is moveable by the locking pin from an abutment position into an evasion position in which the locking pin is released from the second transmission abutment. Accordingly, the locking pin is no longer in contact with the second transmission abutment. The second transmission abutment is therefore moved by the locking pin into an evasion position of no longer projecting into the guide track. In other words, the second transmission abutment is entrained (only) during a part of the closing movement by the locking pin.

Preferably, a further movement of the locking pin is enabled into a latching portion by movement of the second transmission abutment into the evasion position.

In order not to require complex continuous synchronization between the drive devices, preferable that the transmission element is stationary in a movement of the locking pin in the latching portion and in an overpressing portion. That means that no movement transmission is required especially upon latching engagement and in the overpressing movement. Accordingly, for example, when unlocking by overpressing the moveable furniture part only has to be moved against the force of the ejection force storage means of a drive device.

It is further preferable that the synchronization device has a synchronization coupling element connected to the transmission element. More specifically, the synchronization coupling element can have a plurality of mutually spaced teeth which can be coupled in movement-transmitting relationship to a synchronization coupling counterpart element in the form of a toothed wheel.

In itself, it is possible for the transmission element to have a carrier body to which the two transmission abutments (and also the synchronization coupling element) are releasably fixed. To provide a simple structure, however, it is preferable that the transmission element has a carrier body. The first transmission abutment, the second transmission abutment, and/or the synchronization coupling element is/are formed in one piece with the carrier body. Accordingly, a single component performs a plurality of functions.

The drive device described hitherto does not have to be used for synchronization or for transmission of movement to a second drive device. Rather, such a drive device can also be installed only individually (and at one side) in an article of furniture. Then the drive device admittedly (actually unnecessarily) also has the components for synchronization, but a drive device of that kind is advantageous insofar as only one kind of drive device (therefore always having synchronization components) has to be produced. That facilitates for example storage and simplifies and unifies production.

The invention relates, however, not only to a single drive device but also to an arrangement having a (first) drive device according to the invention and a second drive device according to the invention which is synchronized therewith. Preferably, that arrangement also has a synchronization bar for connecting the synchronization devices, in particular the synchronization coupling counterpart elements, of the two drive devices.

In addition, an article of furniture comprises a furniture carcass, at least one furniture part moveable relative to the furniture carcass and a drive device according to the invention or an arrangement with two drive devices. Preferably, those two drive devices are mounted at opposite sides of the furniture carcass or the moveable furniture part.

The carriers of the drive devices can be fixed to the moveable furniture part (or to a drawer rail of a drawer extension guide assembly), in which case then the ejection devices eject together with the moveable furniture part on entrainment members (associated with the furniture carcass). Preferably, however, the carriers of the drive devices are fixed to the furniture carcass (preferably each at a carcass rail of a drawer extension guide assembly), and the ejection devices move the moveable furniture part relative to the furniture carcass in the opening direction by entrainment members (associated with the moveable furniture part).

BRIEF DESCRIPTION OF THE INVENTION

Figure 2:
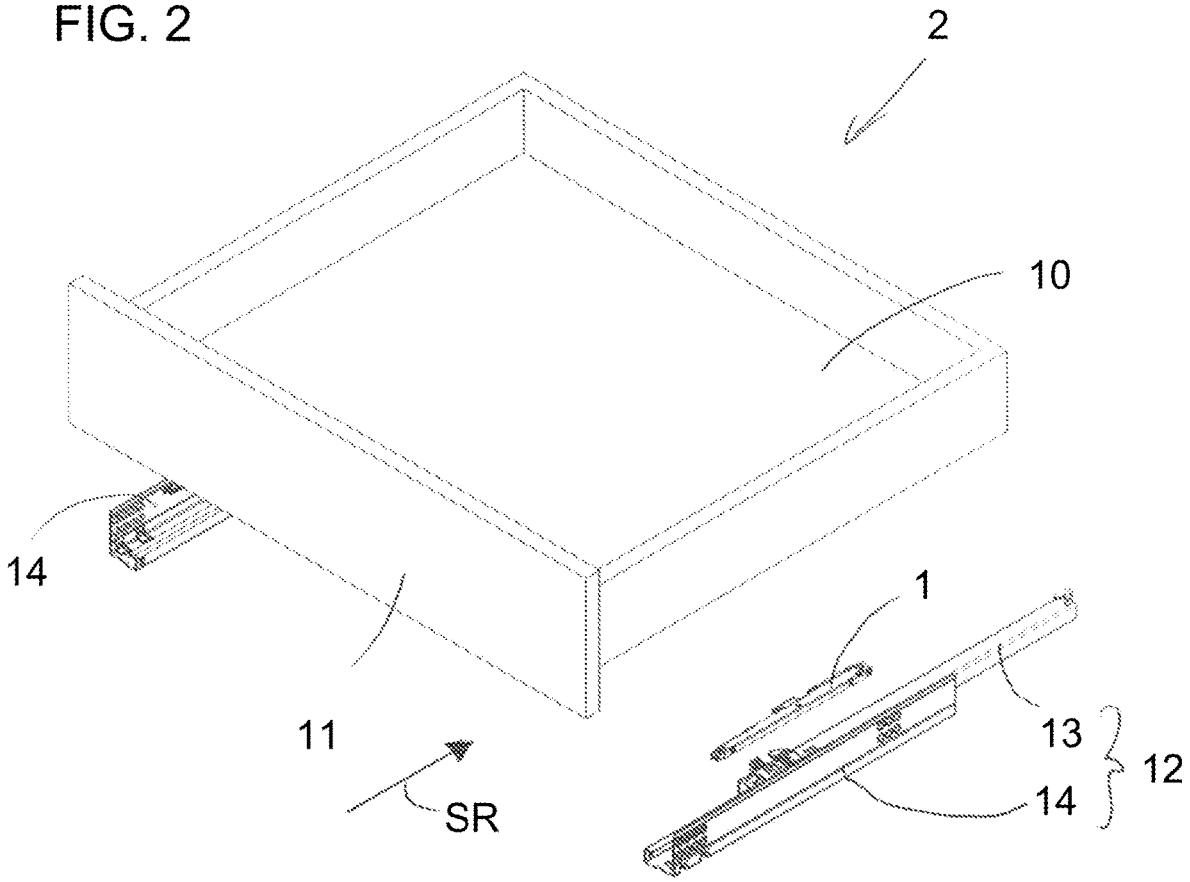
Figure 3:
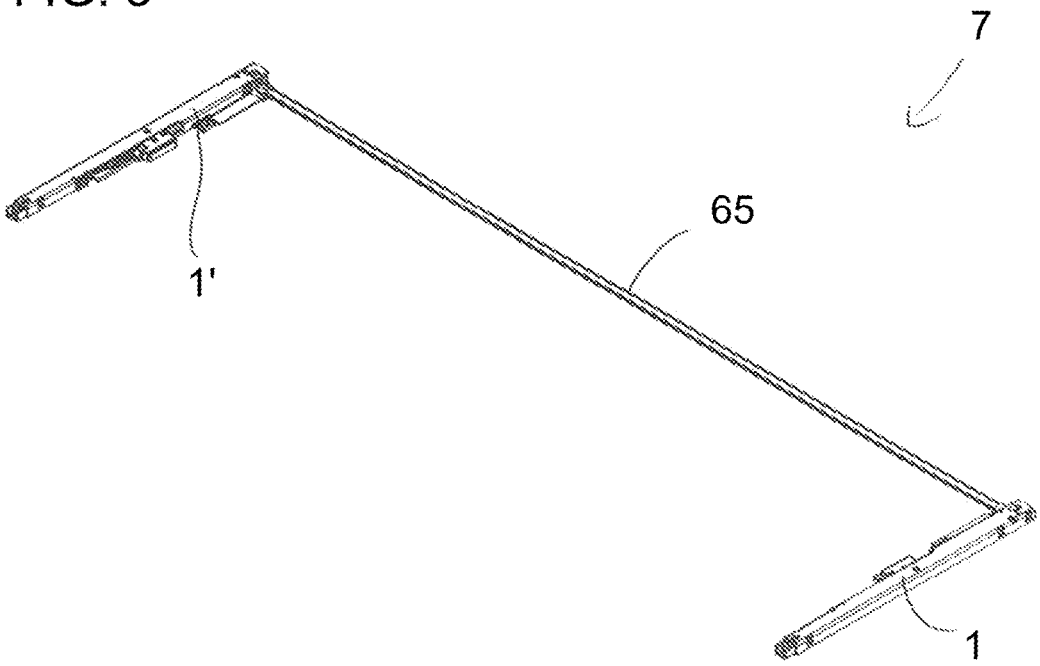
Figure 4:
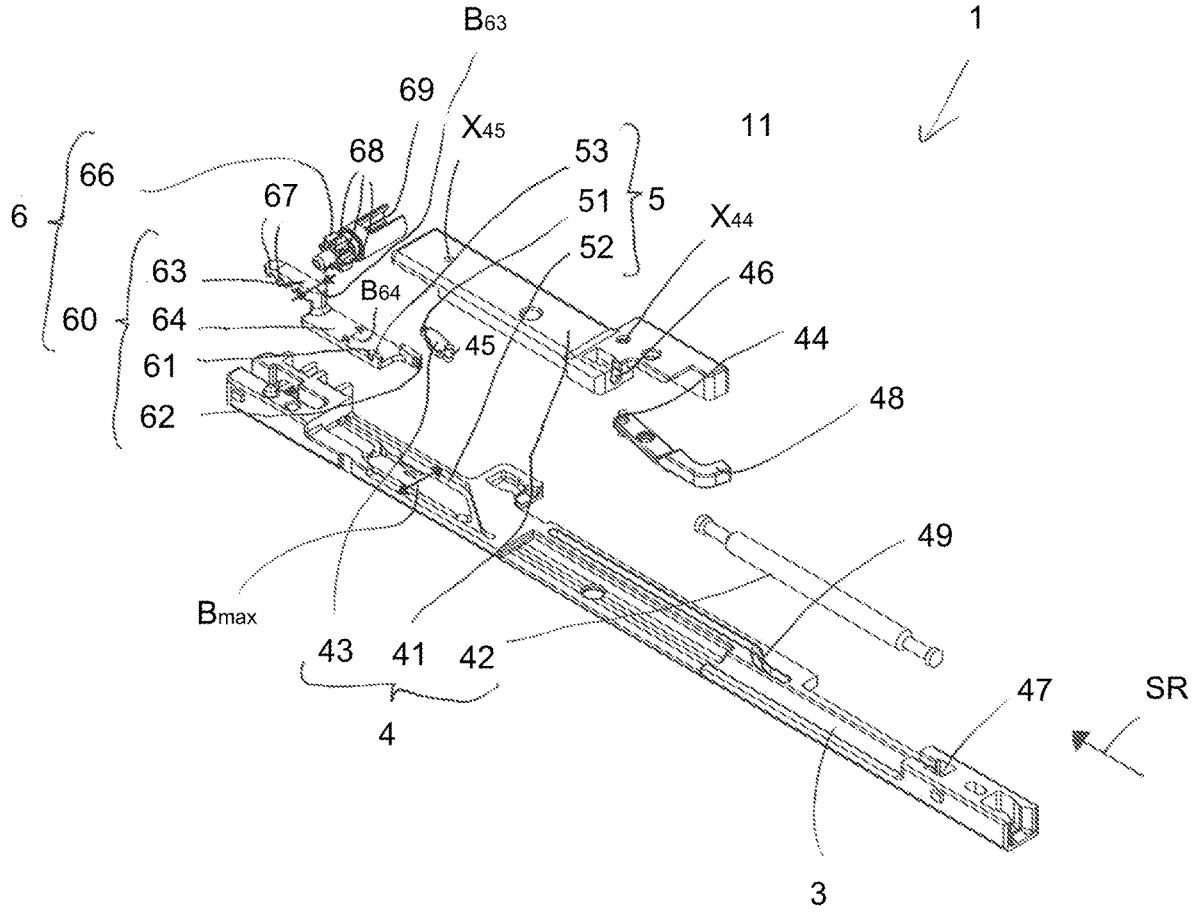
Figure 5A:
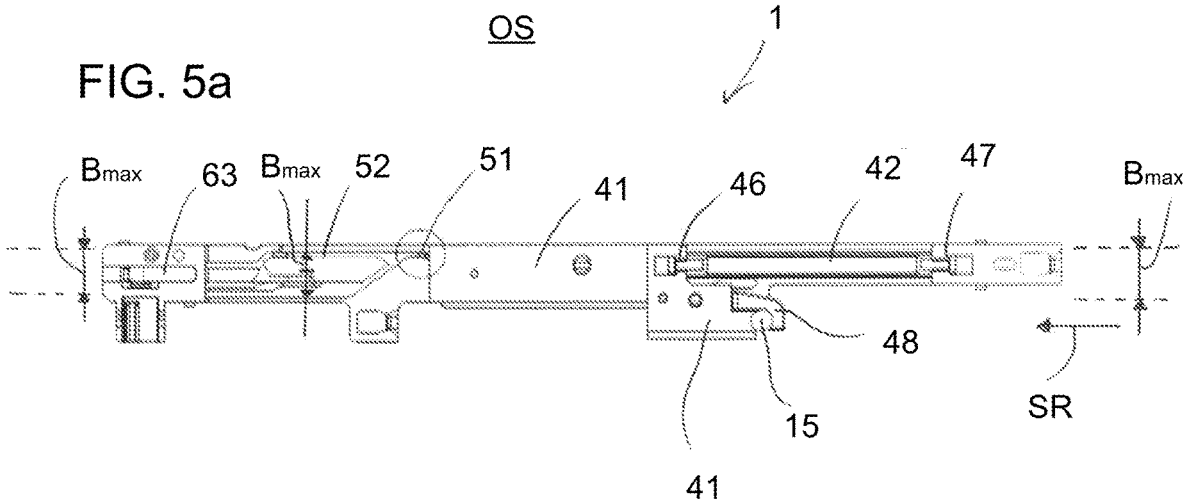
Figure 5B:
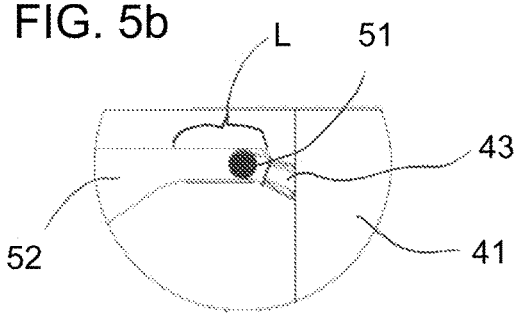
Figure 5C:
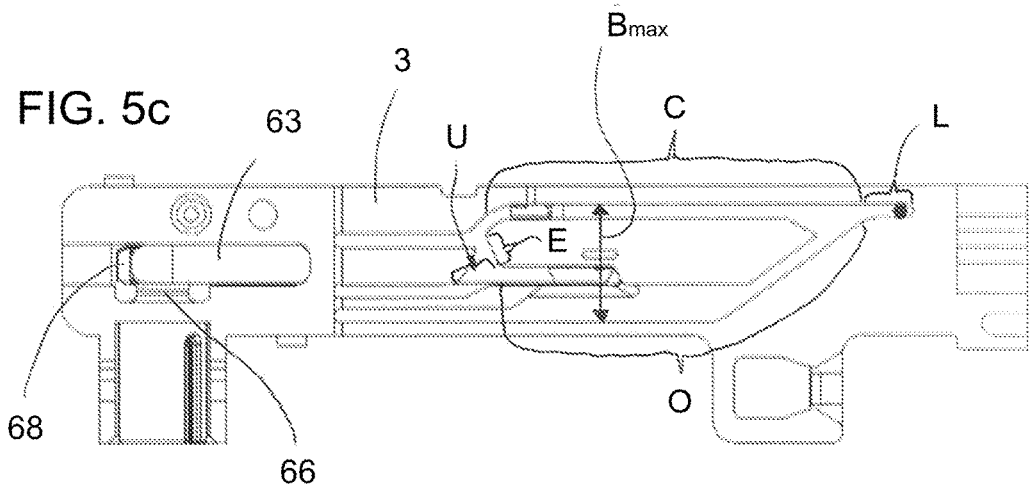
Figure 6A:
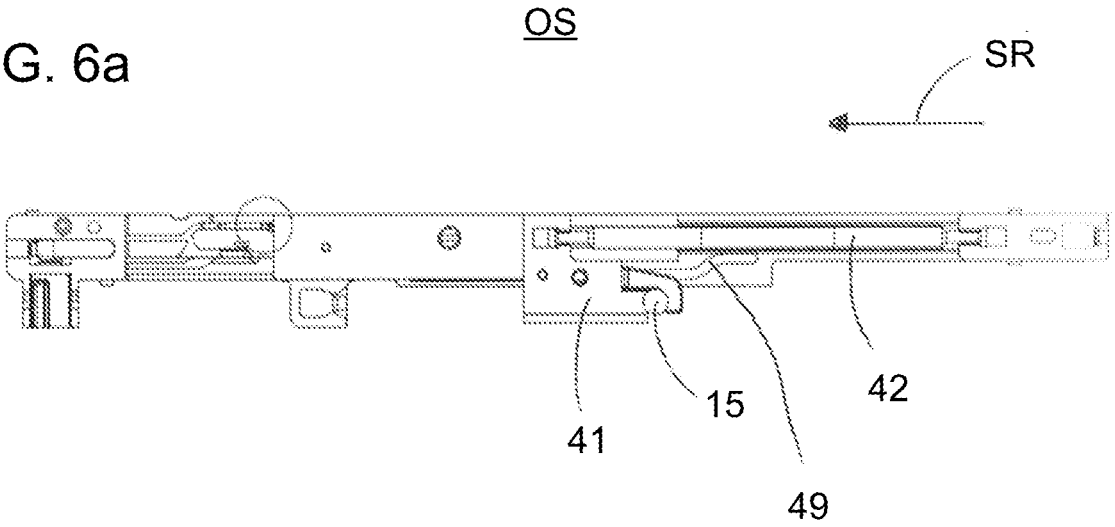
Figure 6B:
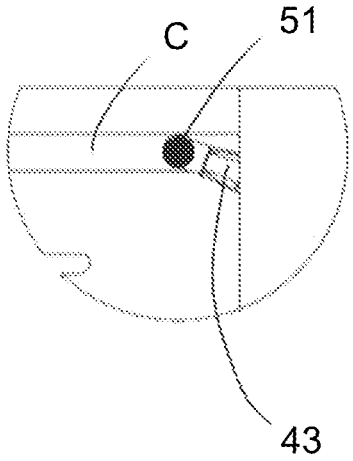
Figure 7A:
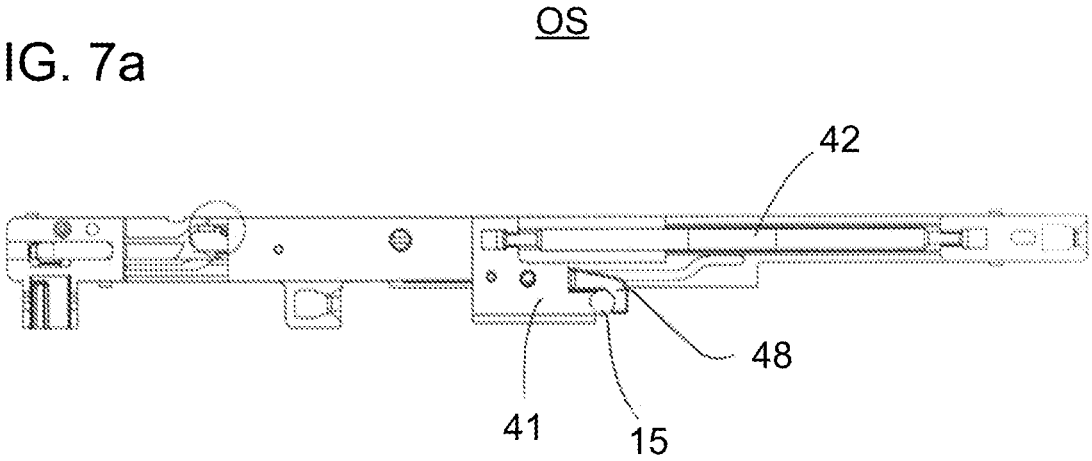
Figure 7B:
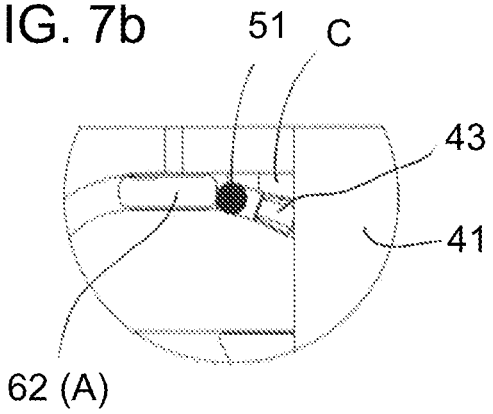
Figure 7C:
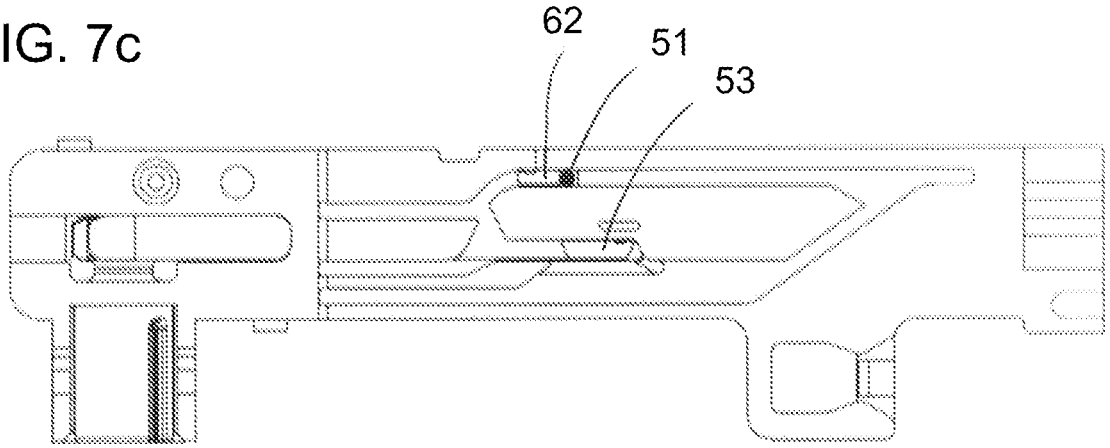
Figure 8A:
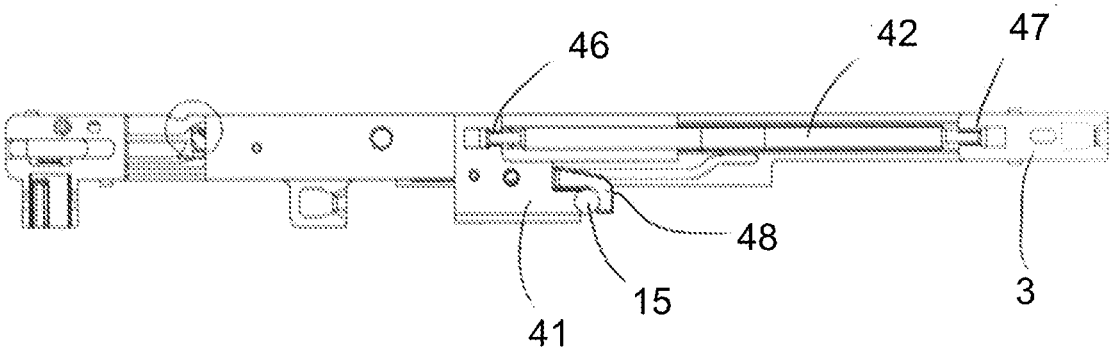
Figure 8B:
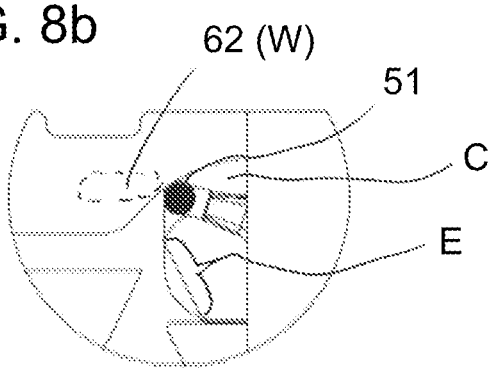
Figure 8C:
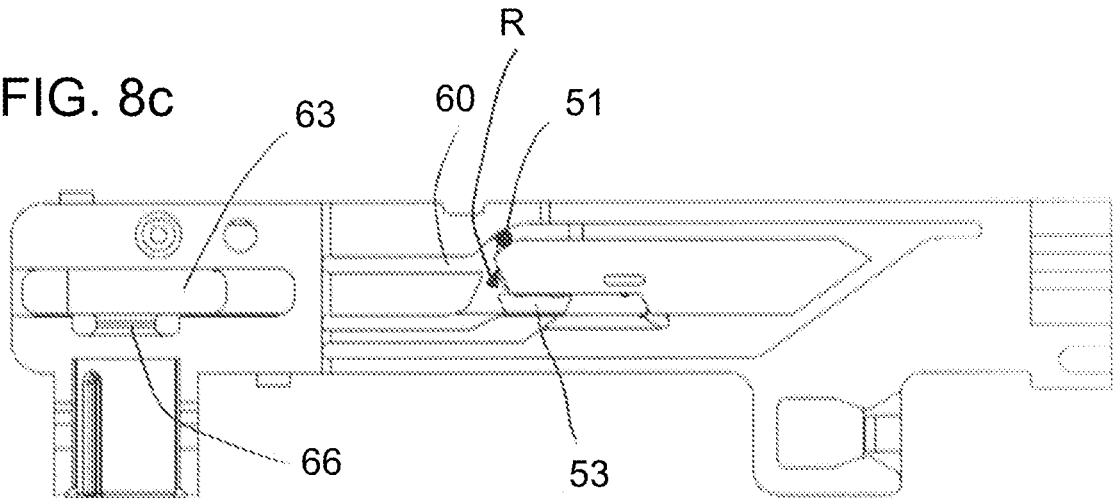
Figure 9A:
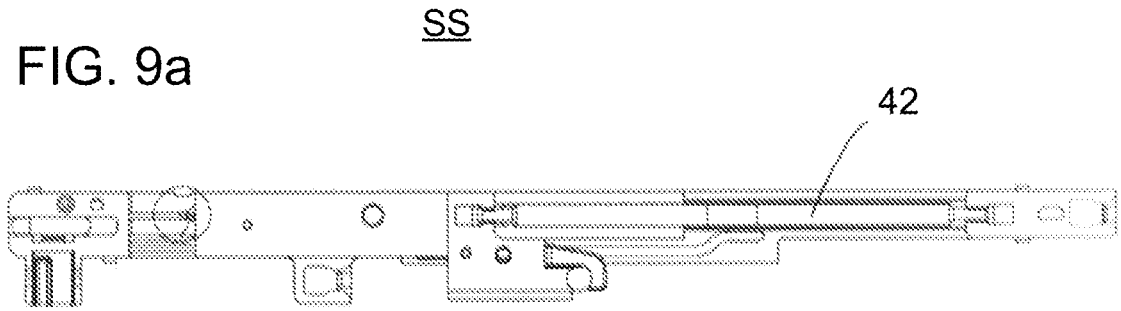
Figure 9B:
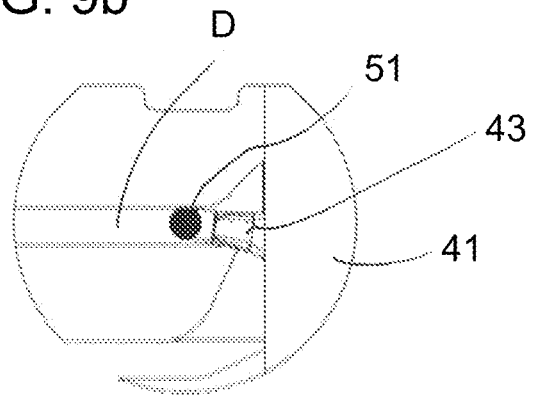
Figure 9C:
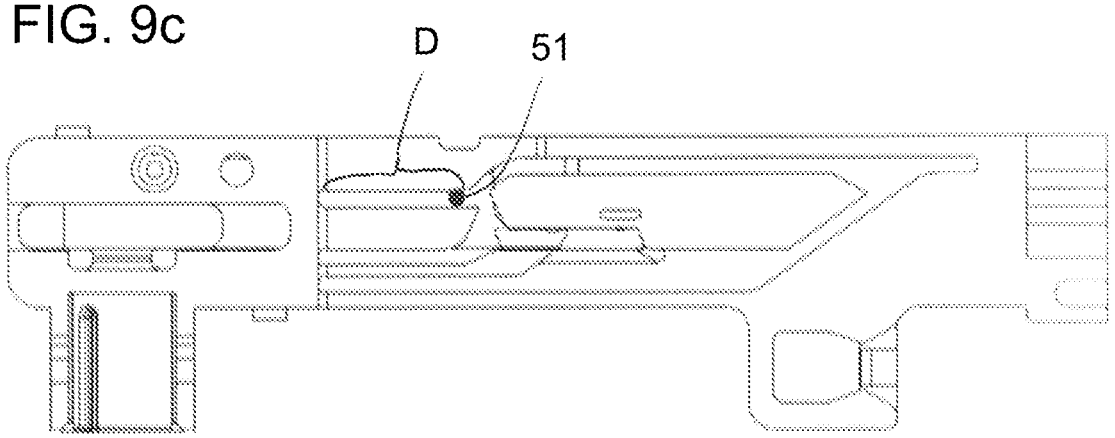
Figure 10A:
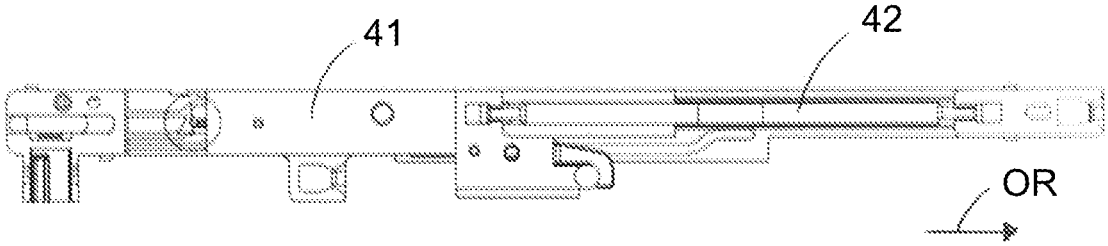
Figure 10B:
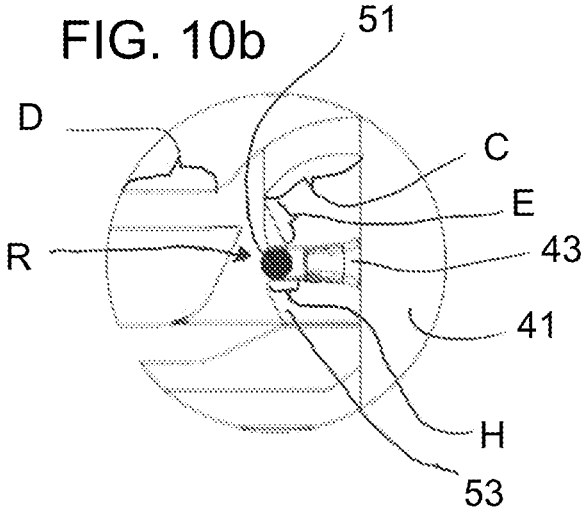
Figure 10C:
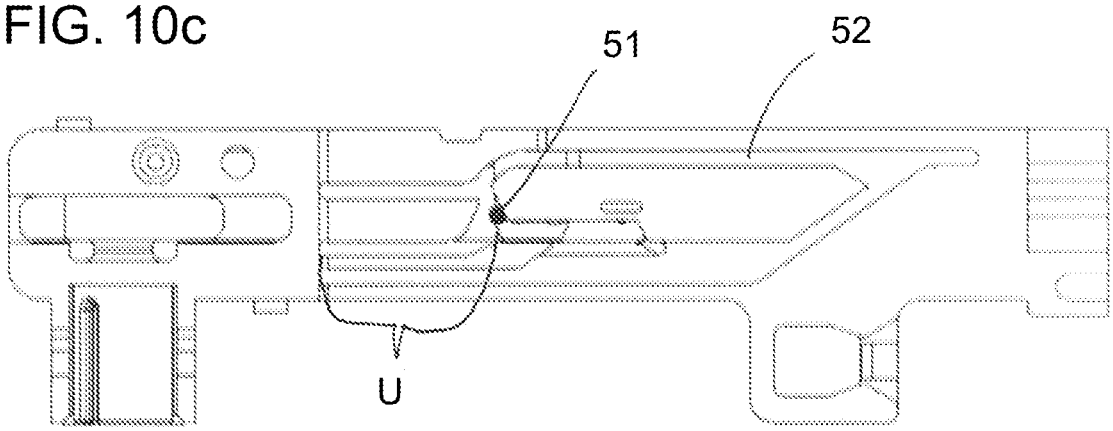
Figure 11A:
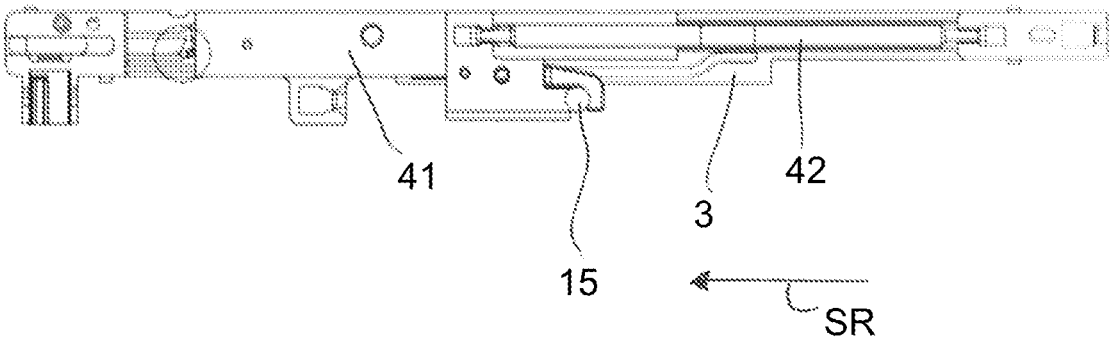
Figure 11B:
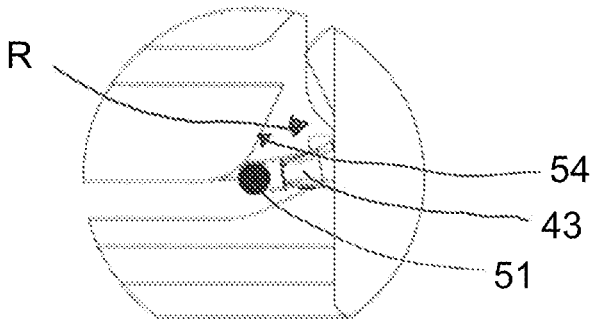
Figure 11C:
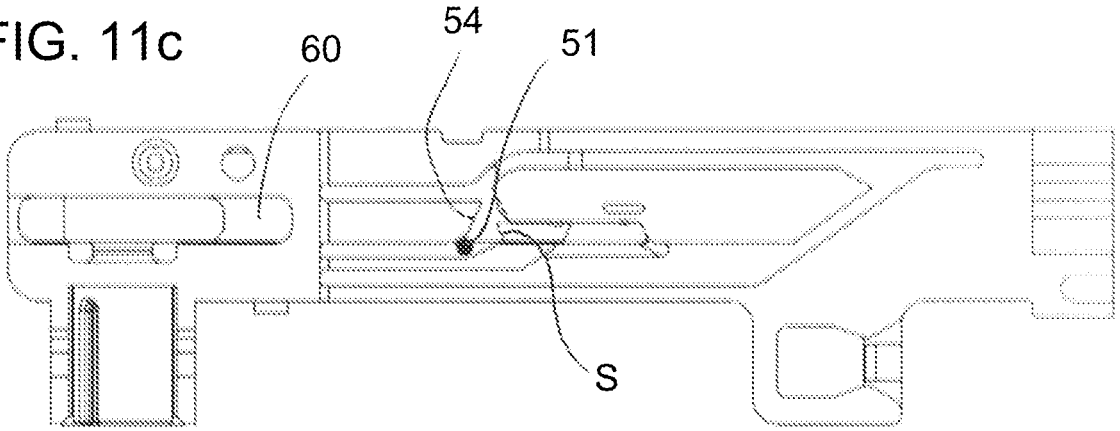
Figure 12A:
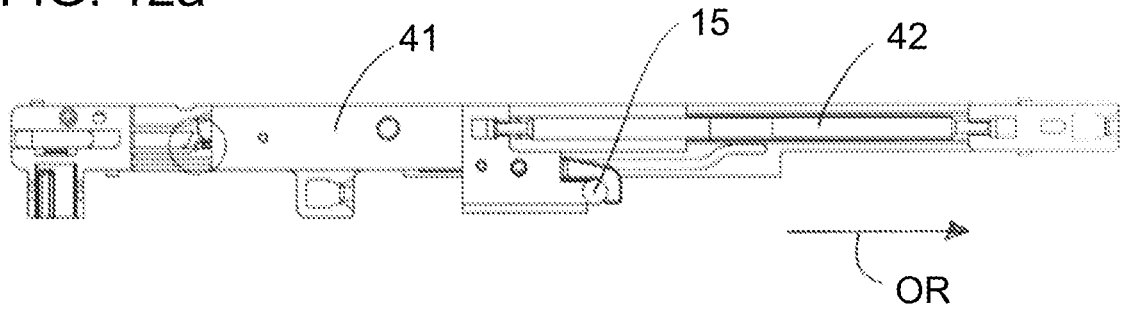
Figure 12B:
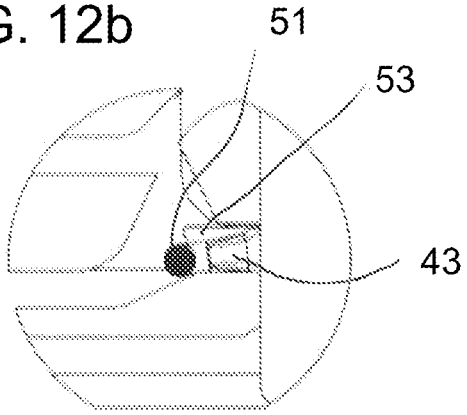
Figure 12C:
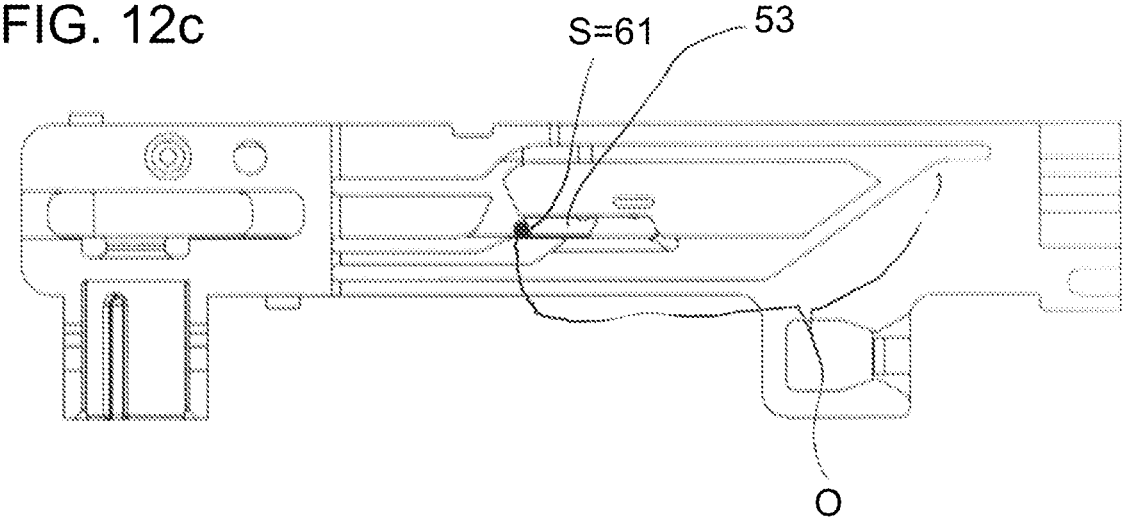
Figure 13A:
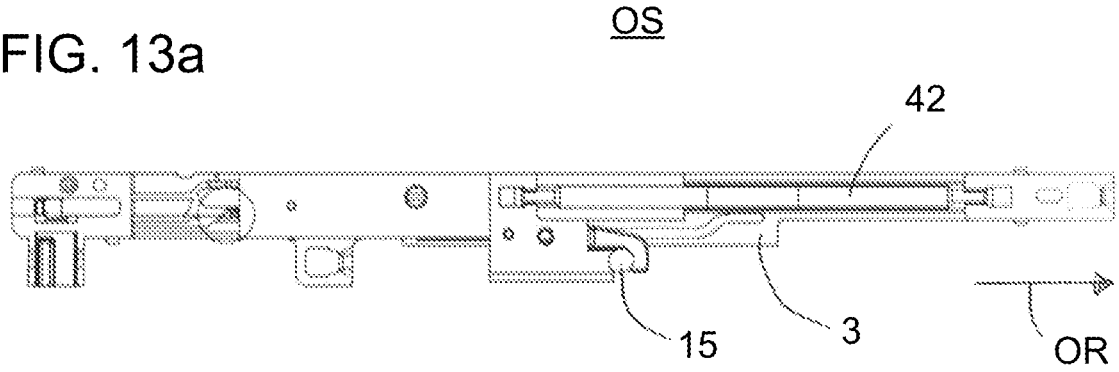
Figure 13B:
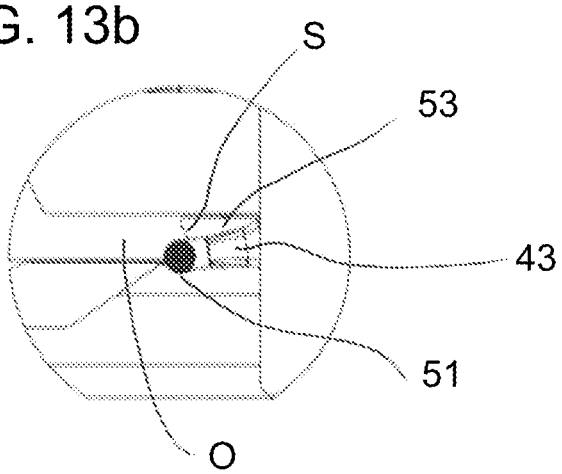
Figure 13C:
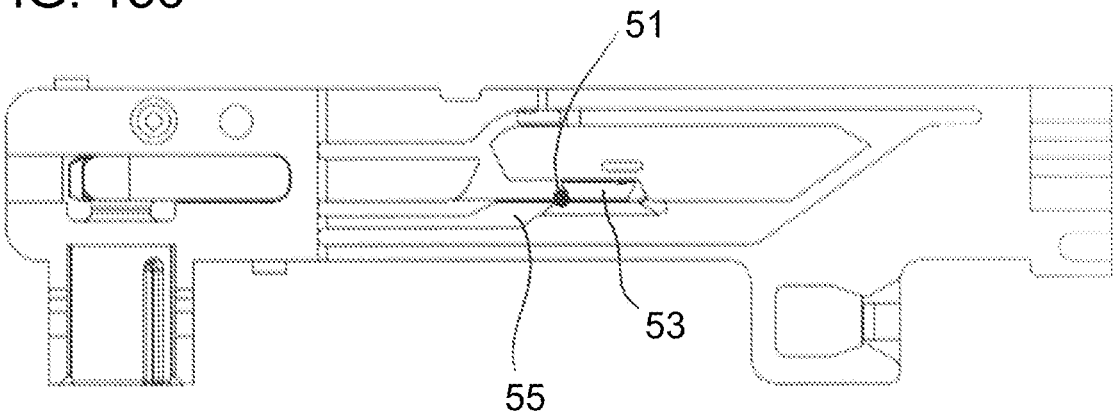
Figure 14A:
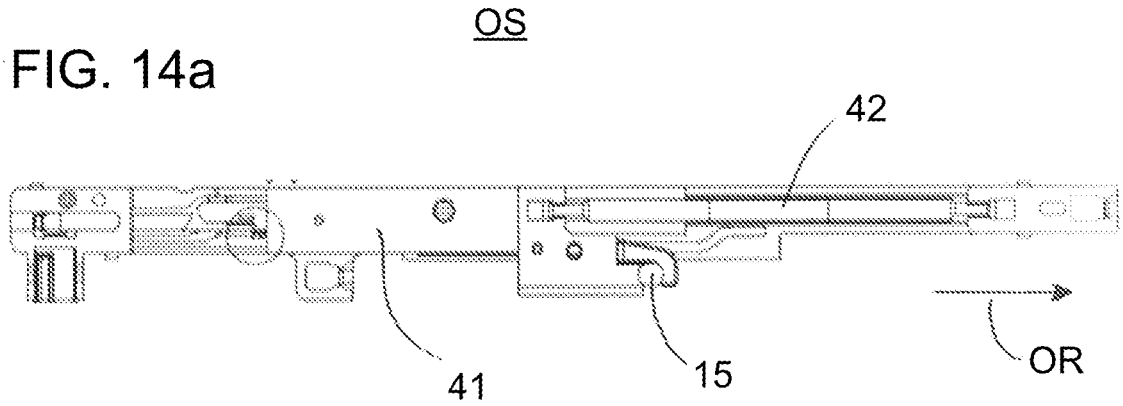
Figure 14B:
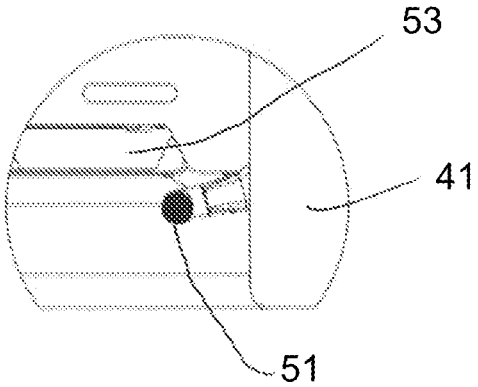
Figure 14C:
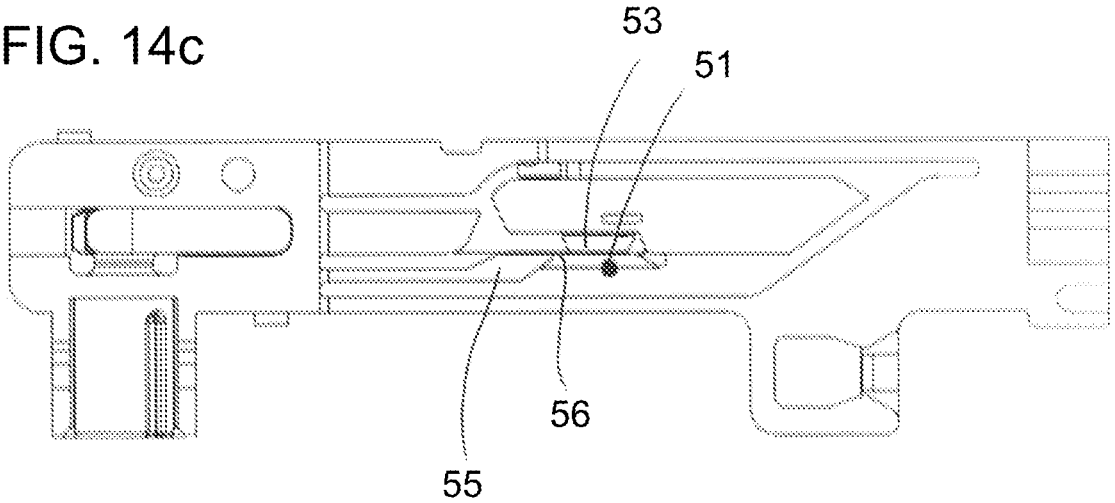
Figure 15:
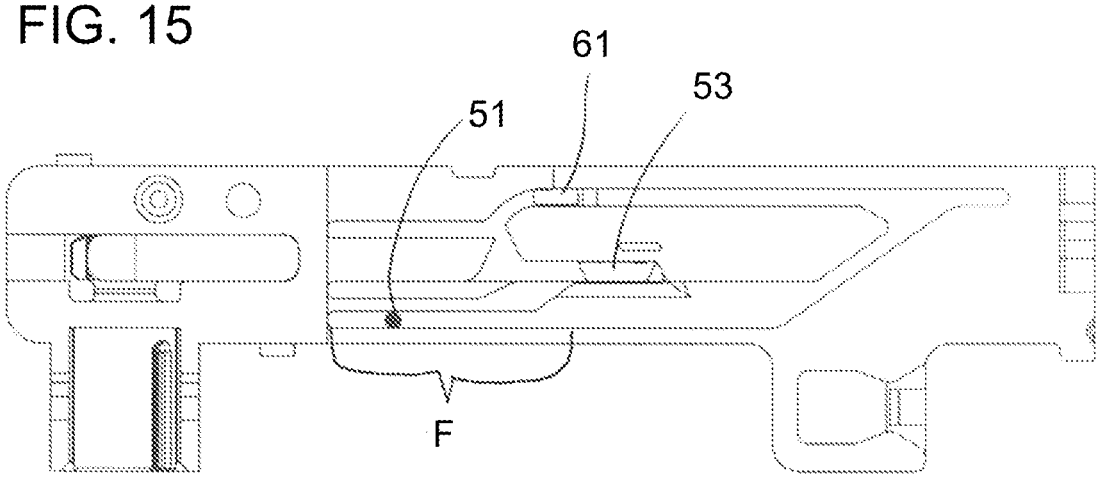
Figure 16A:
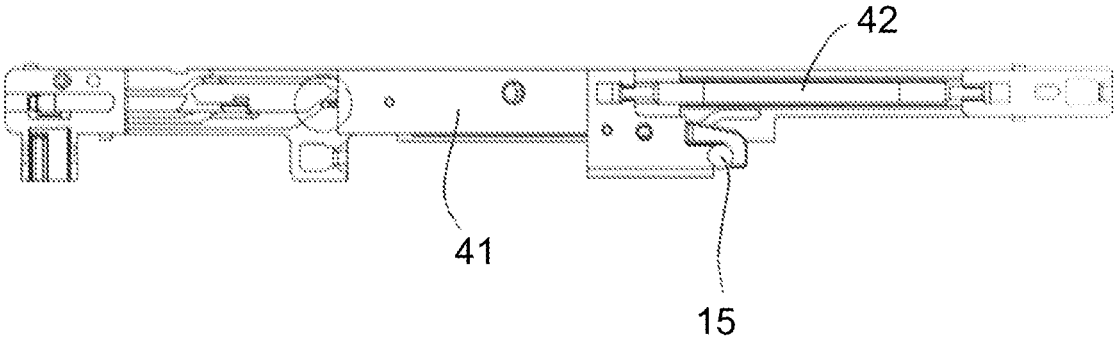
Figure 16B:
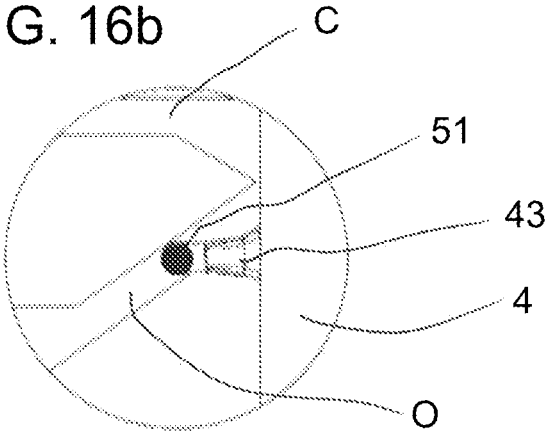
Figure 16C:
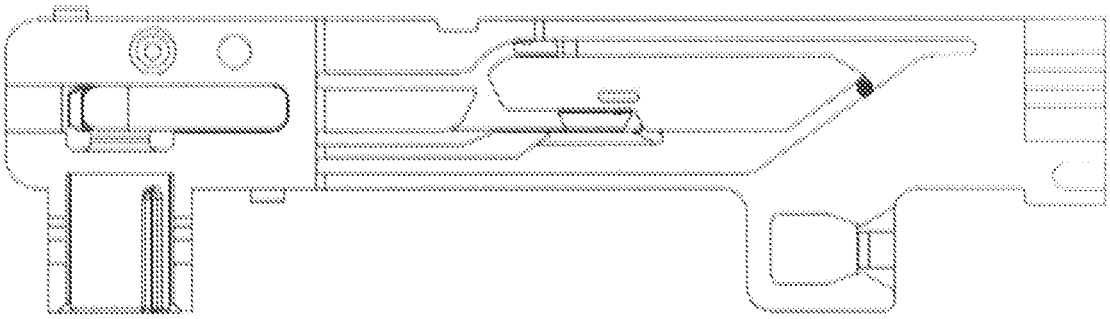

Further details and advantages of the present invention are described more fully hereinafter by means of the specific description with reference to the embodiments by way of example illustrated in the drawings in which:

FIG. 1 diagrammatically shows an article of furniture with a plurality of moveable furniture parts in the form of drawers, FIG. 2 is a perspective view of a drawer with drawer extension guide assemblies and a drive device for a moveable furniture part, FIG. 3 shows an arrangement comprising two synchronized drive devices, FIG. 4 is an exploded perspective view of the drive device, FIGS. 5*a*-5*c* are various views of the drive device in the open position, FIGS. 6*a*-6*b* are various views of the drive device upon closing, FIGS. 7*a*-7*c* are various views of the drive device upon abutment of the locking pin against the second transmission abutment, FIGS. 8*a*-8*c* are various views of the drive device upon release of the locking pin from the second transmission abutment, FIGS. 9*a*-9*c* are various views of the drive device in the closed position, FIGS. 10*a*-10*c* are various views of the drive device in the locking position, FIGS. 11*a*-11*c* are various views of the drive device in the overpressing position, FIGS. 12*a*-12*c* are various views of the drive device upon abutment of the locking pin against the first transmission abutment, FIGS. 13*a*-13*c* are various views of the drive device upon release of the locking pin from the first transmission abutment, FIGS. 14*a*-14*c* are various views of the drive device during the ejection movement, FIG. 15 is a plan view of a part of the drive device with the locking pin in the run-free passage, and FIGS. 16*a*-16*c* are various views of the drive device in the open position.

DETAILED DESCRIPTION OF THE INVENTION

FIG. 1 quite generally shows an article of furniture 8 comprising a furniture carcass 9 and a total of four moveable furniture parts 2. Each furniture part 2 comprises at least a drawer receptacle box 10 and a front panel 11. The moveable furniture parts 2 are fixed to the furniture carcass 9 by way of a drawer extension guide assembly 12 comprising a drawer rail 13 and a carcass rail 14 (and possibly a central rail which is not shown).

A drive device 1 is diagrammatically shown in relation to the uppermost drawer. The drive device 1 has a carrier 3. In this case, the carrier 3 is mounted to the drawer rail 13 (in the diagrammatic view in FIG. 1 the carrier 3 corresponds to the drawer rail 13). The drive device 1 has an ejection device 4, the ejection slide 41 and the ejection force storage means (ejection force accumulator) 42 of the ejection device 4 being shown diagrammatically. The locking device 5 has a guide track 52 which is provided in the carrier 3, and the locking pin 51 guided in the guide track 52 (which in this case is of a cardioid shape). Arranged on the carcass rail 14 (or on the furniture carcass 9 itself) is an entrainment member 15, with which the ejection device 4 is at least partially in engagement. The arrangement however can also be reversed. That is to say, the drive device 1 can be associated with the carcass rail 14 while the entrainment member 15 is associated with the moveable furniture part 2. This uppermost drawer is in the open position OS.

When the drawer is moved from that open position OS in the closing direction SR, then the locking pin 51 is displaced in the closing portion C of the guide track 52 (see hereinafter in the detail). In that case, the ejection force storage means 42 is stressed by a relative movement between the ejection slide 41 and the carrier 3.

The ejection force storage means 42 is fully stressed in the closed position (third drawer from the top). That closed position SS can be reached by a purely manual closing movement. Alternatively the moveable furniture part 2—if present—can be moved or retracted into the closed position SS by the retraction device 16 (only diagrammatically illustrated) which is integrated in the extension guide assembly 12.

Starting from that closed position SS, the moveable furniture part 2 moves into the overpressing position ÜS (lowermost drawer in FIG. 1) by pressing against the moveable furniture part 2. The locking device 5 is unlocked as a result. After the overpressing action which is performed in the closing direction SR, the moveable furniture part 2—as soon as the user is no longer pressing against the moveable furniture part 2—is ejected in the opening direction OR by the drive device 1. As a result, the moveable furniture part 2 moves into the open position OS as shown by the second drawer from the top. In that position, the drawer can be gripped for example by the front panel 11 and manually moved further into the open position shown by the first drawer from the top.

FIG. 2 shows a perspective view of a moveable furniture part 2 in the form of a drawer with a drawer receptacle box 10 and a front panel 11. The Figure also shows a drawer extension guide assembly 12 comprising a drawer rail 13 and a carcass rail 14, wherein a drawer extension guide assembly 12 is provided on both sides of the moveable furniture part 2. FIG. 2 further shows a drive device 1. The drive device 1 is mounted to the carcass rail 14. That drive device 1 (or its carrier 3) extends in the closing direction SR of the moveable furniture part 2. In particular, in the case of smaller or narrower drawers, it is sufficient if only one drive device 1 is associated with the moveable furniture part 2. That one drive device 1 can be associated with the right-side drawer extension guide assembly 12 (as shown) or the left-side drawer extension guide assembly 12.

In the case of wider or larger drawers it is advantageous—in particular to avoid tilting or jamming of the drawer in the furniture carcass 9—if mutually synchronized drive devices 1 and 1' are provided on both sides of the moveable furniture part. In matching relationship therewith FIG. 3 shows an arrangement 7 comprising a (first) drive device 1 and a second drive device 1'. Those two drive devices 1 and 1' are connected together by a synchronization bar 65. More specifically, portions of the opening movement and the closing movement of the drive devices 1 and 1' are synchronized with each other. The first drive device 1 is of a mirror-image symmetrical configuration with the second drive device 1'. Otherwise the drive devices 1 and 1' are of an identical configuration.

FIG. 4 shows an exploded perspective view of a drive device 1. That drive device 1 has an elongated carrier 3. The carrier 3 is releasably connected to the drawer rail 13. Snap connections or screw connections for example can be provided for that purpose. A cardioid-shaped guide track 52 for the locking pin 51 is formed in the carrier 3. The guide track 52 together with the locking element 53 and the locking pin 51 form the locking device 5 for the ejection device 4.

The ejection device 4 in turn has the ejection slide 41, the control lever 43 which is mounted moveably (preferably rotatably) to the ejection slide 41 and the ejection force storage means (ejection force storage accumulator) 42. The ejection slide 41 is linearly displaceably mounted to the carrier 3. Provided in the ejection slide 41 is an axis of rotation $X_{45}$. The control lever 43 is mounted rotatably in or at that axis of rotation $X_{45}$, with its axis counterpart portion 45. The locking pin 51 is arranged or formed on the control lever 43. The first force storage accumulator base 46 is provided in the ejection slide 41. The second force storage accumulator base 47 is provided on the carrier 3. The ejection force storage accumulator 42 in the form of a tension spring is fixed with one end to the first force storage accumulator base 46 and with the other end to the second force storage accumulator base 47. The axis of rotation $X_{44}$ for the entrainment catch lever 48 is provided on the ejection slide 41. That lever 48 is mounted rotatably by way of the axis counterpart portion 44 in the axis of rotation $X_{44}$. The entrainment catch lever 48 is guided by a guide element in the sliding guide track 49 in the carrier 3.

The drive device 1 also has a synchronization device 6. The synchronization device 6 includes on the one hand a transmission element 60 linearly moveable on the carrier. The transmission element 60 in turn has a carrier body 64, a first transmission abutment 61, a second transmission abutment 62 and a synchronization coupling element 63. The synchronization coupling element 63 has teeth 67 spaced from each other in the closing direction SR. On the other hand, the synchronization device 6 also includes a synchronization coupling counterpart element 66. The synchronization coupling counterpart element 66 is mounted rotatably to the carrier 3. The synchronization coupling counterpart element 66 has a toothed wheel with teeth 68. Those teeth 68 mesh with the teeth 67. The synchronization bar 65 can be fixed in the receiving element 69 provided in the synchronization coupling counterpart element 66.

It can also be seen from FIG. 4 that the synchronization coupling element 63, measured at a right angle to the closing direction SR, is of a smaller maximum width $B_{63}$ than the maximum width $B_{64}$, as measured at a right angle to the closing direction SR, of the carrier body 64 of the transmission element 60.

It can also be seen from FIG. 4 that the guide track 52 is of a maximum guide track width $B_{max}$ measured at a right angle to the closing direction SR. That maximum width $B_{max}$ is also shown once again in FIGS. 5*a* and 5*c*. As viewed in the closing direction SR the synchronization coupling element 63 and the ejection force storage means 42 are arranged within that guide track width $B_{max}$, as is shown by the broken line in FIG. 5*a*. As a result the drive device 1 is of a relatively narrow configuration.

FIG. 5*a* shows a plan view of the assembled drive device 1. The ejection force storage means (ejection force storage accumulator) 42 is held to the two force storage accumulator bases 46 and 47. The entrainment member 15 is caught between the entrainment member catch lever 48 and the ejection slide 41. The left-hand region of FIG. 5*a* shows the side of the synchronization coupling element 63, which faces away from the teeth 67. The guide track 52 provided in the carrier 3 can be seen here. The synchronization coupling element 63 is disposed in the closing direction SR behind the guide track 52 while the ejection force storage means 42 is disposed in the closing direction SR in front of the guide track 52. The locking pin 51 guided in the guide track 52 is disposed in FIG. 5*a* entirely at the (right-hand) end of the guide track 52 in a mounting portion L. That position of the drive device 1 shown in FIG. 5*a* corresponds to a completely open position OS of the moveable furniture part 2.

In matching relationship therewith, the detail in FIG. 5*b* shows that the locking pin 51 on the control lever 43 is disposed in the mounting portion L.

FIG. 5*c* shows a plan view of a part of the drive device 1 shown in FIG. 5*a*, with the right-hand region and the ejection slide 41 not being shown. The locking pin 51 is disposed in the mounting portion L of the guide track 52. The guide track 52 also has the closing portion C in which the locking pin 51 is moveable upon a closing movement of the moveable furniture part 2. There then follows the latching portion E in which the locking pin 51 is moveable after leaving the closing portion C. That is then followed by the overpressing portion Ü. That is in turn adjoined by the opening portion O in which the locking pin 51 is moveable upon opening or ejection of the moveable furniture part 2. That opening portion O finally transitions again into the mounting portion L or into the closing portion C respectively. It is also possible to see in the left-hand region of FIG. 5*c*, beside the rear side of the synchronization coupling element 63, a tooth 68 of the synchronization coupling counterpart element 66.

In FIG. 6*a* the moveable furniture part 2 has moved in the closing direction SR but is still in an open position OS. By virtue of the closing movement the entrainment member 15 associated with the moveable furniture part 2 is moved in the closing direction SR and in so doing entrains the ejection slide 41. As a result the ejection slide 41 moves relative to the carrier 3 and the ejection force storage means 42 is stressed.

In the detail shown in FIG. 6*b* it can be seen that the locking pin 51 is no longer in the mounting portion L but in the closing portion C of the guide track 52.

Referring to FIG. 7*a* the moveable furniture part 2 and therewith the ejection slide 41 have moved still further in the closing direction SR. The moveable furniture part 2 however is still in the open position OS. The ejection force storage means 42 has been still further stressed.

In the detail view shown in FIG. 7*b* the locking pin 51 has moved in the closing portion C to such an extent that the locking pin 51 abuts against the second transmission abutment 62 which projects into the guide track 52. In specific terms the transmission element 60 of the synchronization device 6 has that second transmission abutment 62 which projects into the closing portion C of the guide track 52. The second transmission abutment 62 is in the abutment position A.

FIG. 7*c* again shows the drive device 1 with the ejection slide 41 faded out.

Referring to FIG. 8*a*, the moveable furniture part 2 has been moved still further in the closing direction SR but the closed position SS has just not yet been reached. Accordingly, the moveable furniture part 2 is still in the open position SOS. The ejection force storage means 42 is almost completely stressed.

Because the locking pin 51 bears against the second transmission abutment 62 in the abutment position A, the transmission element 60 in the closing movement (from FIG. 7*a* to FIG. 8*a*) is moveable by the locking pin 51 by way of that second transmission abutment 62. The second transmission abutment 62 is moveable by the locking pin 51 from the abutment position A into the (sunk) evasion position W (see the broken line in FIG. 8*b*) in which the second transmission abutment 62 no longer projects into the guide track 52 and the locking pin 51 disengages from the second transmission abutment 62. That movement of the second transmission abutment 62 into the evasion position W enables a further movement of the locking pin 51 into the latching portion E.

It can be seen from FIG. 8*a* that it is (exclusively) by the movement of the transmission element 60, that is triggered in the closing movement by the locking pin 51 by way of the second transmission abutment 62, that the locking element 53 (on the transmission element 60) is moveable into a latching recess-forming position in which the locking element 53 forms the latching recess R of the guide track 52. The synchronization coupling element 63 is also moved at the same time with that movement of the transmission element 60, which in turn triggers a rotary movement of the synchronization coupling counterpart element 66. That rotary movement is transmitted to a second drive device 1' by way of the synchronization bar 65. Accordingly this last portion of the closing movement in the closing portion C is synchronized.

As shown in FIG. 9*a* the moveable furniture part 2 has been moved still further in the closing direction SR whereby the closed position SS is reached. The ejection force storage means 42 is fully stressed.

As can be seen in FIGS. 9*b* and 9*c*, the locking pin 51 has even moved into the pressing-through prevention passage D of the guide track 52. The transmission element 60 remains stationary in that (pushing-through) movement. That is to say, there is no synchronization or transmission of movement to the second drive device 1'.

If in that position as shown in FIGS. 10*a* through 10*c* the user ceases pressing against the moveable furniture part 2 then the ejection force storage means 42 can be slightly relieved and in that case moves the ejection slide 41 slightly in the opening direction OR so that the locking pin 51 moves along the latching portion E until the locking pin 51 latches in the latching recess R. That gives the locking position VS of the locking device 5, as is shown in FIGS. 5*a*, 5*b* and 5*c*. The latching recess R is formed by the last region of the latching portion E and by the holding surface of the locking element 53. The transmission element 6 remains stationary even in that movement of the locking pin 51 in the latching portion E. In other words, there is no synchronization or transmission of movement to the second drive device 1'.

FIGS. 11*a*, 11*b* and 11*c* show the overpressing movement. When pressure is applied in the closing direction SR to the moveable furniture part 2 which is in the closed position SS as shown in FIGS. 10*a* through 10*c* the moveable furniture part 2 moves into the overpressing position ÜS. That overpressing movement of the moveable furniture part is transmitted by the entrainment member 15 to the ejection slide 41 of the ejection device 4 and to the control lever 43 connected to the ejection slide so that the locking pin 51 on the control lever 43 is released from the latching recess R, is deflected by the inclined deflection portion 55 and passes into the overpressing portion U (with overpressing passage) of the guide track 52. The control lever 43 is still further pivoted in the counter-clockwise direction by that deflection. The locking position VS is nulified and the locking device 5 is unlocked. The transmission element 6 also remains stationary in that overpressing movement.

If in that overpressing position US shown in FIGS. 11*a* through 11*c* the user ceases to press against the moveable furniture part the ejection force storage means 42 can be relieved as the locking pin 51 is no longer locked. By virtue of that relief effect, the ejection slide 41 and therewith the locking pin 51 are moved along the opening portion O of the guide track 52. In that movement the locking pin 51 firstly encounters the end face S on the locking element 53. In FIG. 12*b* the locking pin 51 is just encountering that end face S. In FIG. 12*c* the locking pin 51 has already moved the locking element 53 slightly in the opening direction OR by way of the end face S. The first transmission abutment 61 is formed by that end face S which is provided on the locking element 53 and which is oriented transversely relative to the holding surface H. The transmission element 60 is moveable in the opening movement by the locking pin 51 by virtue of that first transmission abutment 61 which projects into the opening portion O of the guide track 52. Accordingly synchronization or transmission of movement in respect of that opening movement to the second drive device 1' takes place. If unlocking has not yet taken place in the second drive device 1' in spite of overpressing of the moveable furniture part 2—for whatever reasons—then the locking element 53 of the second drive device 1' is moved in the opening direction OR by that synchronization effect so that the locking element 53 no longer constitutes the latching recess R and the locking pin 53 of the second drive device 1' is unlocked.

In FIGS. 13*a*, 13*b* and 13*c* the ejection force storage means 42 has been relieved of stress still a little further so that the open position OS of the moveable furniture part 2 is reached. The locking pin 51 still bears against the end face S of the locking element 53, but is already deflected by that inclined end face S by virtue of the gap between the locking element 53 and the peninsular-shaped region 55 of the guide track 52. The movement of the transmission element 60 and thus synchronization of the second drive device 1' is thus concluded.

In FIGS. 14*a*, 14*b* and 14*c* the ejection force storage means 42 has been still further relieved of stress. The locking pin 51 has moved entirely through the gap 56.

If, starting from that position as shown in FIGS. 14*a* through 14*c*—in which actually the ejection movement by the ejection device 4 takes place—a pressing force is by mistake applied to the moveable furniture part 2 in the closing direction SR then the locking pin 51, by virtue of the configuration of the opening portion O, cannot pass into the overpressing portion U or into the latching recess R again. For that reason the guide track 52 has the run-free passage F shown in FIG. 15. It is therein that the locking pin 51 can move non-destructively in the event of an excessively early closing movement implemented by mistake.

In FIGS. 16*a*, 16*b* and 16*c* the ejection or opening movement is almost concluded. The locking pin 51 is disposed in the last region of the opening portion O. The ejection force storage means 42 is almost completely relieved of stress or load.

Finally the moveable furniture part 2 and the drive device 1 pass again into the position shown in FIGS. 5*a* through 5*c*. If in that position a user further pulls on the moveable furniture part in the opening direction OR then the entrainment catch lever 48 is rotated in the counter-clockwise direction about the axis of rotation $X_{44}$ by virtue of the cardioid configuration of the sliding guide track 49. As a result the entrainment member 15 is no longer caught between the ejection slide 41 and the lever 48.

The moveable furniture part 2 can be freely moved. The drive device 1 is stationary and is not influenced by the moveable furniture part 2.

LIST OF REFERENCES

1 (first) drive device
1' second drive device
2 moveable furniture part
3 carrier
4 ejection device
41 ejection slide
42 ejection force storage means
43 control lever
44 axis of rotation counterpart portion
45 axis of rotation counterpart portion
46 first force storage means base
47 second force storage means base
48 entrainment member catch lever
49 sliding guide track
5 locking device
51 locking pin
52 guide track
53 locking element
54 inclined deflection portion
55 peninsular region
56 gap
6 synchronization device
60 transmission element
61 first transmission abutment
62 second transmission abutment
63 synchronization coupling element
64 carrier body
65 synchronization bar
66 synchronization coupling counterpart elements
67 teeth
68 teeth
69 receiving means
7 arrangement
8 article of furniture
9 furniture carcass
10 drawer receptacle box
11 front panel
12 drawer extension guide assembly
13 drawer rail
14 carcass rail
15 entrainment member
16 retraction device
SS closed position
OS open position
ÜS overpressing position
VS locking position
R latching recess H holding surface
O opening portion
S end face
C closing portion
A abutment position
W evasion position
E latching portion
U overpressing portion
L mounting portion
D pressing-through prevention passage
F run-free passage
SR closing direction
OR opening direction
$B_{max}$ maximum guide track width
$B_{63}$ maximum width of the synchronization coupling element
$B_{64}$ maximum width of the carrier body
$X_{44}$ axis of rotation
$X_{45}$ axis of rotation

The invention claimed is:

1. A drive device for a moveable furniture part, comprising:

a carrier;

an ejection device for ejecting the moveable furniture part out of a closed position into an open position, wherein the ejection device is unlockable out of a locking position by an overpressing movement of the moveable furniture part into an overpressing position behind the closed position;

a locking device for locking the ejection device in the locking position, wherein the locking device has a locking pin connected to the ejection device and a guide track provided at least partially in or on the carrier for guiding the locking pin, wherein the locking pin in the locking position is locked in a latching recess of the guide track, and a synchronization device moveable relative to the carrier for synchronizing a movement of the drive device with a movement of a second drive device, wherein the synchronization device has a transmission element moveable by the locking pin, wherein the transmission element is stationary during the overpressing movement, is moveable in an opening movement by the locking pin, and is moveable in a closing movement by the locking pin, wherein the transmission element is linearly moveably mounted to the carrier, and the transmission element has:

a first transmission abutment projecting into an opening portion of the guide track, the first transmission abutment being configured such that, during the opening movement, the transmission element is moveable by the locking pin via the first transmission abutment, and a second transmission abutment projecting into a closing portion of the guide track, the second transmission abutment being configured such that, during the closing movement, the transmission element is moveable by the locking pin via the second transmission abutment.

2. The drive device as set forth in claim 1, wherein arranged on the transmission element is a locking element for locking the locking pin, the locking element also forming a portion of the guide track.

3. The drive device as set forth in claim 2, wherein the locking pin is lockable in the locking position in the latching recess of the guide track, the latching recess being at least partially formed by the locking element moveable relative to the carrier, and the locking pin being held in the locking position on the locking element.

4. The drive device as set forth in claim 2, wherein the first transmission abutment is formed by an end face on the locking element.

5. The drive device as set forth in claim 2, wherein the locking element is moveable into a latching recess-forming position in which the locking element also forms the latching recess of the guide track by the movement of the transmission element triggered in the closing movement by the locking pin via the second transmission abutment.

6. The drive device as set forth in claim 1, wherein the second transmission abutment is moveable by the locking pin from an abutment position into an evasion position in which the locking pin is released from the second transmission abutment.

7. The drive device as set forth in claim 6, wherein movement of the second transmission abutment into the evasion position allows a further movement of the locking pin into a latching portion.

8. The drive device as set forth in claim 7, wherein the transmission element is stationary during a movement of the locking pin in the latching portion and in an overpressing portion.

9. The drive device as set forth in claim 1, wherein the synchronization device has a synchronization coupling element connected to the transmission element.

10. The drive device as set forth in claim 1, wherein the transmission element has a carrier body, and at least one of the first transmission abutment, the second transmission abutment, and a synchronization coupling element is formed to have a one-piece configuration with the carrier body.

11. An arrangement comprising:

a first drive device and a second drive device each configured as set forth in claim 1, and a synchronization bar for connecting respective synchronization devices of the first and second drive devices.

12. An article of furniture comprising:

a furniture carcass;

a furniture part moveable relative to the furniture carcass; and the drive device as set forth in claim 1.

13. The drive device as set forth in claim 3, wherein the locking pin is held in the locking position on the locking element at a holding surface provided on the locking element.

14. The drive device as set forth in claim 4, wherein the end face on the locking element is oriented transversely relative to the holding surface.

15. The drive device as set forth in claim 5, wherein the locking element is moveable into the latching recess-forming position exclusively by the movement of the transmission element triggered in the closing movement by the locking pin via the second transmission abutment.

16. The arrangement as set forth in claim 11, wherein the synchronization bar connects synchronization coupling counterpart elements of the respective synchronization devices of the first and second drive devices.

* * * * *